US011821232B2

(12) United States Patent
Bolen, Jr.

(10) Patent No.: US 11,821,232 B2
(45) Date of Patent: Nov. 21, 2023

(54) INFLATABLE COVER DEVICE

(71) Applicant: James Bolen, Jr., Hazlet, NJ (US)

(72) Inventor: James Bolen, Jr., Hazlet, NJ (US)

( * ) Notice: Subject to any disclaimer, the term of this patent is extended or adjusted under 35 U.S.C. 154(b) by 0 days.

(21) Appl. No.: 17/520,888

(22) Filed: Nov. 8, 2021

(65) Prior Publication Data

US 2023/0039673 A1 Feb. 9, 2023

Related U.S. Application Data

(60) Provisional application No. 63/229,671, filed on Aug. 5, 2021.

(51) Int. Cl.
*E04H 4/10* (2006.01)

(52) U.S. Cl.
CPC ..... *E04H 4/103* (2013.01)

(58) Field of Classification Search
CPC ..... E04H 4/10; E04H 4/103; E04H 4/105
See application file for complete search history.

(56) References Cited

U.S. PATENT DOCUMENTS 4,825,479 A * 5/1989 Bonneau ..... E04H 4/105 220/350
6,954,948 B1 * 10/2005 Asack ..... E04H 4/10 4/498
10,363,197 B2 * 7/2019 Potucek ..... E04H 4/12
2003/0037371 A1 * 2/2003 Shaw ..... E04H 4/10 4/498
2007/0245478 A1 * 10/2007 Painter ..... E04H 4/10 4/498
2020/0270886 A1 * 8/2020 Guilfoyle ..... A61H 33/6005

FOREIGN PATENT DOCUMENTS

FR 2650853 A1 * 8/1989
WO WO-9113012 A1 * 9/1991
WO WO-2019186186 A1 * 10/2019

* cited by examiner

*Primary Examiner* — Janie M Loeppke

(74) *Attorney, Agent, or Firm* — Brennan, Manna & Diamond, LLC

(57) ABSTRACT

The present invention relates generally to the field of covers or enclosures for pools, spas or hot tubs. More specifically, the present invention relates to an inflatable cover or enclosure having an inflatable body. The cover includes a side surface with an integrated retaining aid, a valve and an integrated pump. The cover or enclosure can be placed on top of a pool, hot tub or spa, or underneath an existing cover and can then be inflated to a shape such as a convex dome-like shape. Once inflated, the cover prevents debris or water from accumulating on the cover.

9 Claims, 4 Drawing Sheets

INFLATABLE COVER DEVICE

CROSS-REFERENCE TO RELATED APPLICATION

The present application claims priority to, and the benefit of, U.S. Provisional Application No. 63/229,671, which was filed on Aug. 5, 2021, and is incorporated herein by reference in its entirety.

FIELD OF THE INVENTION

The present invention relates generally to the field of accessories for personal recreational facilities. More specifically, the present invention relates to a pool or spa cover that is inflatable and is comprised of an inflatable body that has a top surface, a side surface with an integrated elastic member, a valve and an integrated pump. The device can be positioned on top of or underneath an existing cover or other enclosure used to cover a pool, spa or hot tub, and can then be inflated to a raised, shaped, convex, dome-like or other shape to cover the pool, spa or hot tub. Once inflated, the shape of the device prevents debris, insects, animals or water from accumulating on the cover the device has been placed under or over top of, and instead allows debris, insects and water to simply slide off the cover or enclosure and onto the nearby area such as a patio, so that the debris can be easily swept away. Accordingly, the present disclosure makes specific reference thereto. Nonetheless, it is to be appreciated that aspects of the present invention are also equally applicable to other like applications, devices and methods of manufacture.

BACKGROUND

Covers and enclosures are used to cover a pool, spa or hot tub when the pool, spa or hot tub is not in use. During colder months when pools, spas or hot tubs are not in use for months at a time, covers or enclosures protect a pool, spa or hot tub in order to prevent debris, insects and other clutter from accumulating and decomposing within the pool, spa or hot tub. However, as enclosures or covers are placed over pools, spas or hot tubs for months at a time during the off-season of a pool, spa or hot tub, water, insects and other debris can accumulate on the surface of the cover or enclosure itself. Water can also accumulate in puddles on a cover or enclosure and form depressions, such that bacteria and algae can form within the puddles or other damp recesses on the cover or enclosure. In addition, any debris such as leaves that land within the puddles will decompose. Insects and small animals such as mice can also get trapped in the puddles and die. As a result, a user must regularly clean the pool, spa or hot tub cover or enclosure to avoid damage to the cover or enclosure by water, algae growth and other debris accumulation and decomposition. However, this process is unnecessarily burdensome and is undesirable.

Therefore, there exists a long-felt need in the art for an improved pool, spa or hot tub cover or enclosure device. There also exists a long-felt need in the art for an inflatable cover or enclosure that prevents water and other debris from accumulating on the surface of an existing cover or enclosure. In addition, there exists a long-felt need in the art for an inflatable cover or enclosure that does not require a user to regularly clean an existing cover or enclosure. Finally, there exists a long-felt need in the art for an inflatable cover or protective enclosure that greatly reduces the amount of effort required when a user does decide to manually clean an existing cover or enclosure.

The subject matter disclosed and claimed herein, in one embodiment thereof, comprises an inflatable cover or enclosure for a pool, spa, hot tub or similar outdoor recreational facility. The invention has an inflatable body that includes a top surface, a side surface with an integrated elastic member, a valve and an integrated pump. The cover or enclosure can be placed on top of or underneath an existing cover or other enclosure, and can then be inflated to form a raised shape such as a convex, dome-like shape or other configuration that will aid in the avoidance of the accumulation of debris. Once inflated, the shape of the device prevents debris or water from accumulating on the cover or enclosure that has been placed under or over top of an existing cover or enclosure, and instead allows debris and water to simply slide or drain off the side of the cover and onto the nearby area around the pool, spa, hot tub or other water-based recreational device.

In this manner, the inflatable cover or enclosure of the present invention accomplishes all of the forgoing objectives and provides an improved cover or enclosure for a pool, spa, hot tub or other similar recreational device. In doing so, the present invention prevents water, debris and other material from accumulating on the surface of an existing cover or enclosure. Further, the present invention eliminates the need for a user to regularly clean an existing cover or enclosure. Finally, the invention greatly reduces the amount of effort required when a user does decide to manually clean an existing cover or enclosure.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises an inflatable cover or enclosure for use in protecting a pool, spa, hot tub or similar recreational facility. The invention has an inflatable body with a top surface, a side surface having an integrated elastic member and a valve and an integrated pump. The body is preferably appropriately sized, shaped and dimensioned, such that it can successfully fit over or under any existing pool, spa or hot tub cover or other protective enclosure. The inflatable component or body portion may also have a plurality of differing materials in various embodiments including, but not limited to, UV-stabilized polyethylene, polypropylene, or vinyl that may be transparent, semi-transparent or opaque, and that may be any color known in the art. The material may be treated with an antifungal, antibacterial or antimicrobial agent, so as to reduce the buildup of bacteria, fungus or microbes.

The central portion or body can further be inflated to form an enlarged area, such as a convex or dome-like shape, in order to create sloped edges so that material, water and other debris will flow off the edges. In order to inflate the central area or body, the top surface or side surface may have at least one valve that allows a user to manually inflate the central portion or body by blowing or otherwise forcing air into the body, or to allow any inflatable device, such as an air compressor, to inflate the central area, outside ring or body. In one embodiment, the invention may have an integrated pump that allows a user to inflate or deflate the central portion or body. The pump may be integrated into the top surface or side surface of the central area, peripheral area or body, and may be powered by at least one battery, by direct current or by at least one solar panel.

In differing embodiments, the device can be placed over top of or underneath any existing pool, spa or hot tub cover, or used on its own as a stand-alone pool, spa or hot tub cover. In an embodiment where the invention is placed underneath an existing cover and then inflated, the inflated configuration creates a shape such as a convex shape, that ensures that no debris or other material can accumulate on the cover or enclosure, and any debris, water or other material will simply run or fall off the cover onto the surrounding area of the pool. Alternatively, the cover or enclosure may have a gutter system that encircles the cover or enclosure, so that the water and other material can be channeled off to a particular area, such as a downspout. In an embodiment where the invention is placed over top of an existing cover or enclosure and the body is inflated, the inflated shape creates a raised area of the body that ensures that no debris, water or other material can accumulate on the top surface, and any debris will simply run off the top and side surfaces onto the surrounding area of the pool, spa or hot tub. The top surface or side surface may also have a transparent viewing window that allows a user to view the interior of the area under the enclosure, such as the water within a pool, spa or hot tub. In addition, the side surface may have an integrated elastic band that further aids in securing and retaining the invention around an above-ground pool, spa or hot tub.

Accordingly, the inflatable pool, hot tub or spa cover or enclosure of the present invention is particularly advantageous, as it prevents water, other material and debris from accumulating on the surface of the cover or enclosure. Further, the device does not require a user to regularly clean material and other debris from the top of the pool, spa or hot tub cover or enclosure. Finally, the invention greatly reduces the amount of effort required when a user does decide to manually clean an existing pool, spa or hot tub cover or enclosure. The shape of the invention itself substantially reduces the amount of debris and other material that can accumulate on the cover or enclosure.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
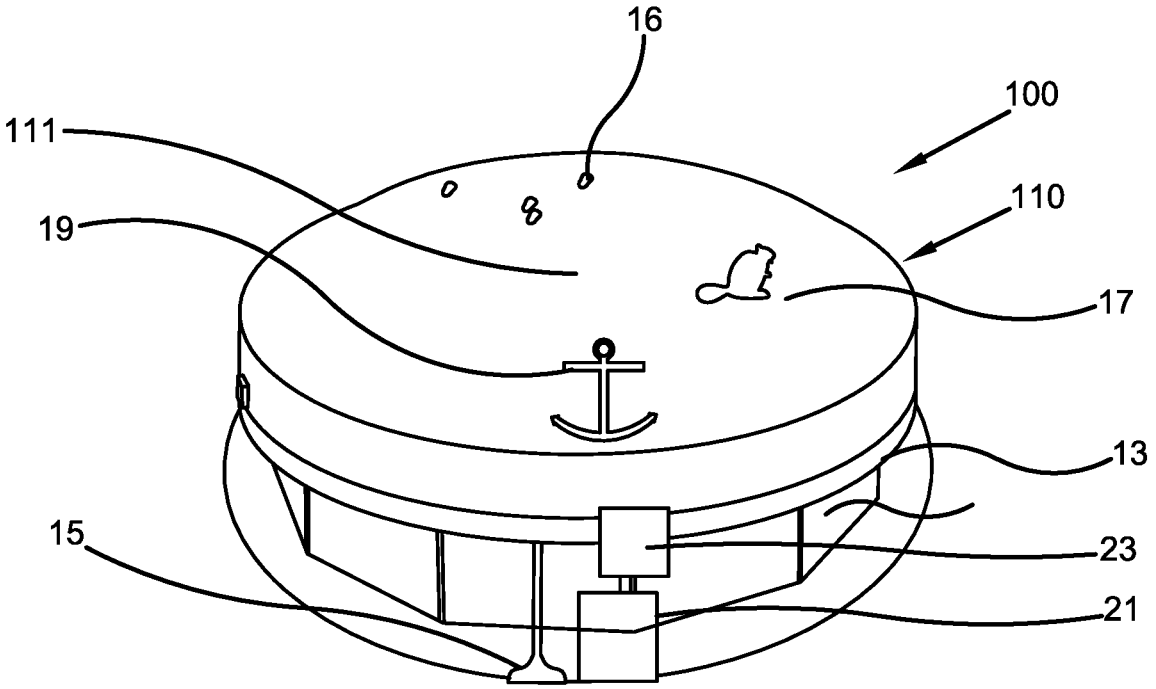
FIG. 1 illustrates a perspective view of one potential embodiment of an inflatable cover or enclosure for a pool, spa or hot tub of the present invention while attached to a pool in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved cover or enclosure for a pool, spa or hot tub. There also exists a long-felt need in the art for an inflatable cover that prevents water, other material and debris from accumulating on the surface of an existing cover or enclosure for a pool, spa or hot tub, and that does not require a user to regularly clean an existing cover, as the invention creates an elevated region in the center of cover or enclosure. Finally, there exists a long-felt need in the art for an inflatable cover or enclosure that greatly reduces the amount of effort required when a user does decide to manually clean an existing cover.

The present invention, in one exemplary embodiment, is comprised of an inflatable cover or enclosure for a pool, spa or hot tub that has an inflatable body with a top surface, a side surface having an integrated elastic member and a valve and an integrated pump. The body is preferably appropriately sized, shaped, and dimensioned such that it can successfully fit over or under any existing cover or enclosure for a pool, spa or hot tub as is known in the art, and may be comprised of a plurality of differing materials including but not limited to: UV-stabilized polyethylene, polypropylene or vinyl that may be transparent, semi-transparent or opaque and that may be any color or include any designs to improve the aesthetics of the cover or enclosure.

The cover or enclosure can further be inflated to form a raised area, extending upward from the surface of the water or edge of the pool, hot tub or spa. The raised area may have a shape such as a convex or dome-like shape, and can be inflated by using at least one valve that allows a user to manually inflate the body by blowing air into the body or to allow any inflating device known in the art, such as an air compressor, to inflate the body. The device may also have an integrated pump that allows a user to inflate or deflate the body of the cover or enclosure. Further, the pump may be integrated into the top surface or side surface of the body of the cover, and may be powered by at least one battery, by at least one solar panel or be connected to a conventional outlet or power source found in a home.

In differing embodiments, the device can be placed over top of or underneath any existing pool, spa or hot tub cover known in the art, thereby retrofitting the cover to include the present invention, or used on its own as a stand-alone pool cover. In an embodiment where the invention is placed underneath an existing cover or enclosure and then inflated, the cover has a raised area such as a convex shape, which ensures that the debris, other material and water which can accumulate on the cover will simply run or fall off the cover onto ground area or into a gutter to be channeled to a convenient area. In an alternative embodiment, the invention can be provided with a water-catchment system, thereby allowing the water to be collected and stored until needed, such as for watering a lawn or garden. The catchment system can be connected to the gutter, and filters or screens can be used to prevent unwanted debris from clogging up the catchment system. In an embodiment where the device is placed over top of an existing cover and the body is inflated, the shaped or convex configuration of the body ensures that no debris, material or water can accumulate on the top surface, and any debris or other material will simply run or fall off the top surface and side surface onto the surrounding area of the pool, into the gutter or catchment system. The top surface or side surface may also have a transparent viewing window that allows a user to view the interior area within a pool, spa or hot tub in an embodiment where the invention is used as a stand-alone cover or enclosure. In addition, the side surface may have an integrated elastic band, or hook and loop type fasteners that further aid in securing and retaining the device around the pool, spa or hot tub.

Accordingly, the inflatable cover or enclosure for a pool, spa or hot tub of the present invention is particularly advantageous as it prevents water, other material and debris from accumulating on the surface of an existing cover. Further, the invention does require that a user must regularly clean an existing cover or enclosure for a pool, spa or hot tub. Finally, the invention greatly reduces the amount of effort required when a user does decide to manually clean an existing cover or enclosure for a pool, spa or hot tub. The raised shape of the cover or enclosure itself substantial reduces the amount of debris, material and water that can accumulate on the device.

Referring initially to the drawings, FIG. 1 illustrates a perspective view of one potential embodiment of an inflatable cover or enclosure for a pool, spa or hot tub 100 of the present invention, while attached to a pool in accordance with the disclosed specification. The invention 100 includes an inflatable body 110 that has a top surface 112, a side surface 114 with an integrated elastic or hook and loop fastener member 116, a valve 118 and an integrated pump 120. In differing embodiments, the body 110 may be appropriately sized, shaped and dimensioned in order to successfully fit over or under any existing pool, spa or hot tub cover 14 known in the art. The cover 14 is appropriately sized, shaped and dimensioned to fit and cover any above-ground or in-ground pool 10. The body 110 may also be manufactured from a plurality of differing materials including, but are not limited to, UV-stabilized polyethylene, polypropylene or vinyl that may be transparent, semi-transparent, or opaque and that may be of any color or have various graphics or designs 17 and 19 added to the exterior of the cover or enclosure. The enclosure or cover 110 has a central portion 111, which may also be comprised of any number of indicia 140 (see FIG. 2) that may be in the form of patterns, logos, emblems, images, symbols, designs, letters, words, characters, animals, advertisements, brands, etc., in various embodiments.

The central portion 111 forms the raised area over the surface of the pool, hot tub or spa. FIG. 1 also provides a gutter 13 which extends around the perimeter of the pool, hot tub or spa. The gutter 13 may be connected to a downspout 15, such that all of the water that falls onto the cover is collected by the gutter and channeled to the downspout and away from the pool, hot tub or spa. In addition, a water catchment system 21 can be added to the gutter 13, so that the water can be collected for later use, such as for watering the lawn or garden. A filter or screen 23 can be positioned in the gutter 13 to block any organic matter from clogging the entry to the catchment system 21.

Figure 2:
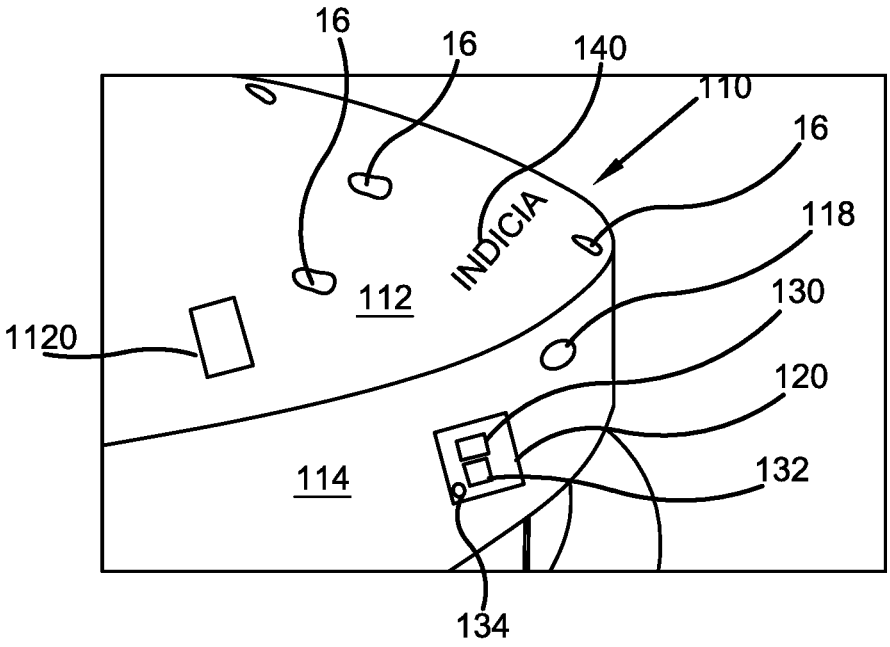
FIG. 2 illustrates an enhanced perspective view of one potential embodiment of an inflatable cover or enclosure for a pool, spa or hot tub of the present invention while attached to a pool in accordance with the disclosed architecture.

FIG. 2 shows the cover or enclosure 110 is preferably hollow, such that it can be inflated. Once fully inflated, the cover 110 forms a raised area having a shape such as a convex or dome-like shape. In order to inflate the cover 110, the top surface 112 or side surface 114 may have at least one air valve 118 that is preferably a switchable valve, to allow inflation or deflation of the cover once inflated. The valve 118 allows a user to manually inflate the body 110 by blowing air into the body 110. In addition, any inflatable device known in the art, such as but not limited to an air-compressor or other pump, can be used to inflate the cover 100. In one embodiment, the cover 100 may have an integrated pump 120 that allows a user to inflate or deflate the body 110 via pressing a button 134. As a result, the pump 120 eliminates the need for a user to manually inflate the cover 110. The pump 120 may further be integrated into the top surface 112 or side surface 114 of the cover 110, and may be powered by at least one battery 130 and/or by at least one solar panel 132 (see FIG. 2). The battery 130 may be a disposable battery or a rechargeable battery in the form of an alkaline, nickel-cadmium, nickel-metal hydride battery, etc. such as any 3V-12 volts DC battery or other conventional battery such as A, AA, AAA, etc., that supply power to the pump. Throughout this specification the term "battery" may be used interchangeably to refer to one or more wet or dry cells or batteries of cells, in which chemical energy is converted into electricity and used as a source of DC power. References to recharging or replacing the battery 130 may refer to recharging or replacing individual cells, individual batteries of cells or a package of multiple battery cells as is appropriate for any given battery technology that may be used. In addition, the solar panel 132 may include, but is not limited to: monocrystalline silicon, polycrystalline silicon or a thin-film, in addition to any number of photovoltaic cells.

Figure 3:
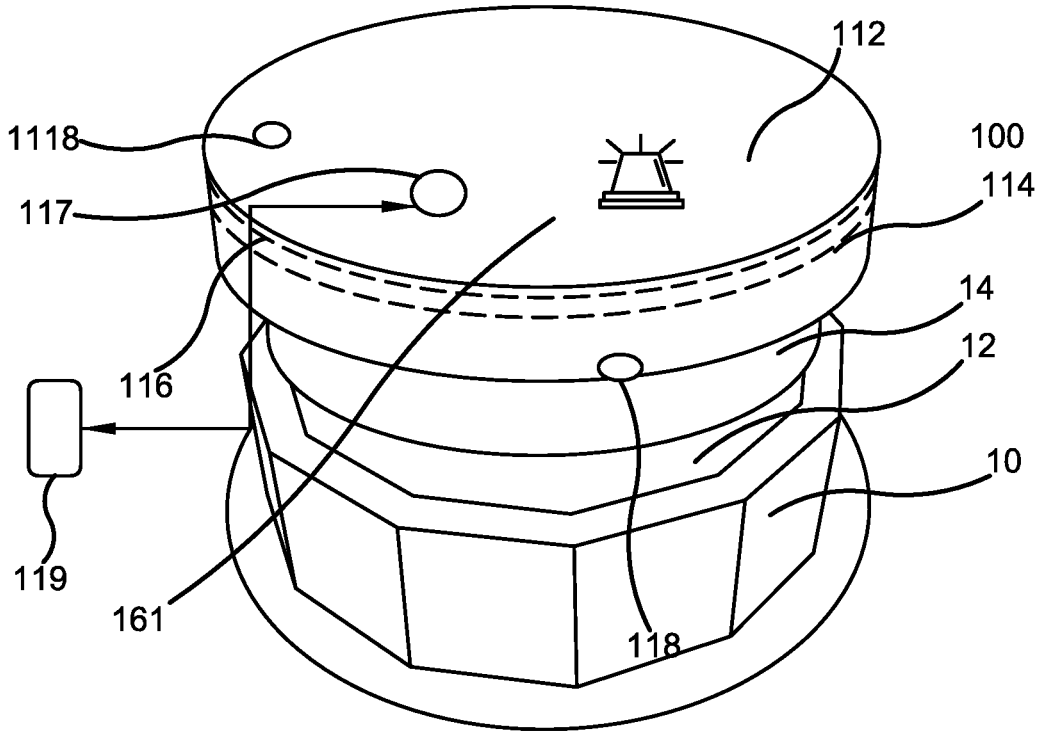
FIG. 3 illustrates an exploded view of one potential embodiment of an inflatable cover or enclosure for a pool, spa or hot tub device of the present invention in accordance with the disclosed architecture.

In should further be appreciated that the device 100 can be placed over top of or underneath any existing pool cover 14 known in the art. FIG. 3 provides an embodiment where the invention 100 is placed underneath an existing pool cover 14 and then inflated, so that a raised area is created and may have a shape such as the convex shape of the cover 110 shown in FIG. 3 ensures that no debris 16 can accumulate on the surface of the cover 16, and any debris 16 will simply run or fall off (or be blown off by the wind or a leaf blower) the cover 14 onto the surrounding ground area of the pool 10. The same is also true for an embodiment where the device 100 is placed over top of an existing pool cover 14 and the body 110 is inflated. The central area of the cover may be inflated using one or more valves 118 and 1118. In this scenario, the convex shape of the body 110 ensures that no debris 16 can accumulate on the top surface 112, and any debris 16 will simply run off (or be blown off by the wind) the top surface 112 and side surface 114 onto the surrounding ground area of the pool 10. The top surface or central area 112 or side surface 114 which extends generally downward from the central area, may also be comprised of a transparent viewing window 1120 (see FIG. 2) that allows a user to view the interior area of the pool, hot tub or spa and the water 12 within a pool 10. In addition, the side surface may have an integrated elastic band 116 that further aids in securing and retaining the device 110 around an above-ground pool 10. The band can be elastic, drawstring, a hook and loop fastening-type system or combinations thereof, to aid in holding the cover in position over the pool. The cover may also have one or more sensors 117 which can be used to determine air pressure, temperature or cover height, as well as to detect other conditions such as bacteria or algae development or combinations thereof. The sensor 117 can be linked to a smart phone 119, which has an application already downloaded to monitor conditions under the cover. The cover may also include a signal or siren 161 for providing a light, audible alarm or combinations thereof to indicate that the cover has deflated below a certain level.

Figure 4:
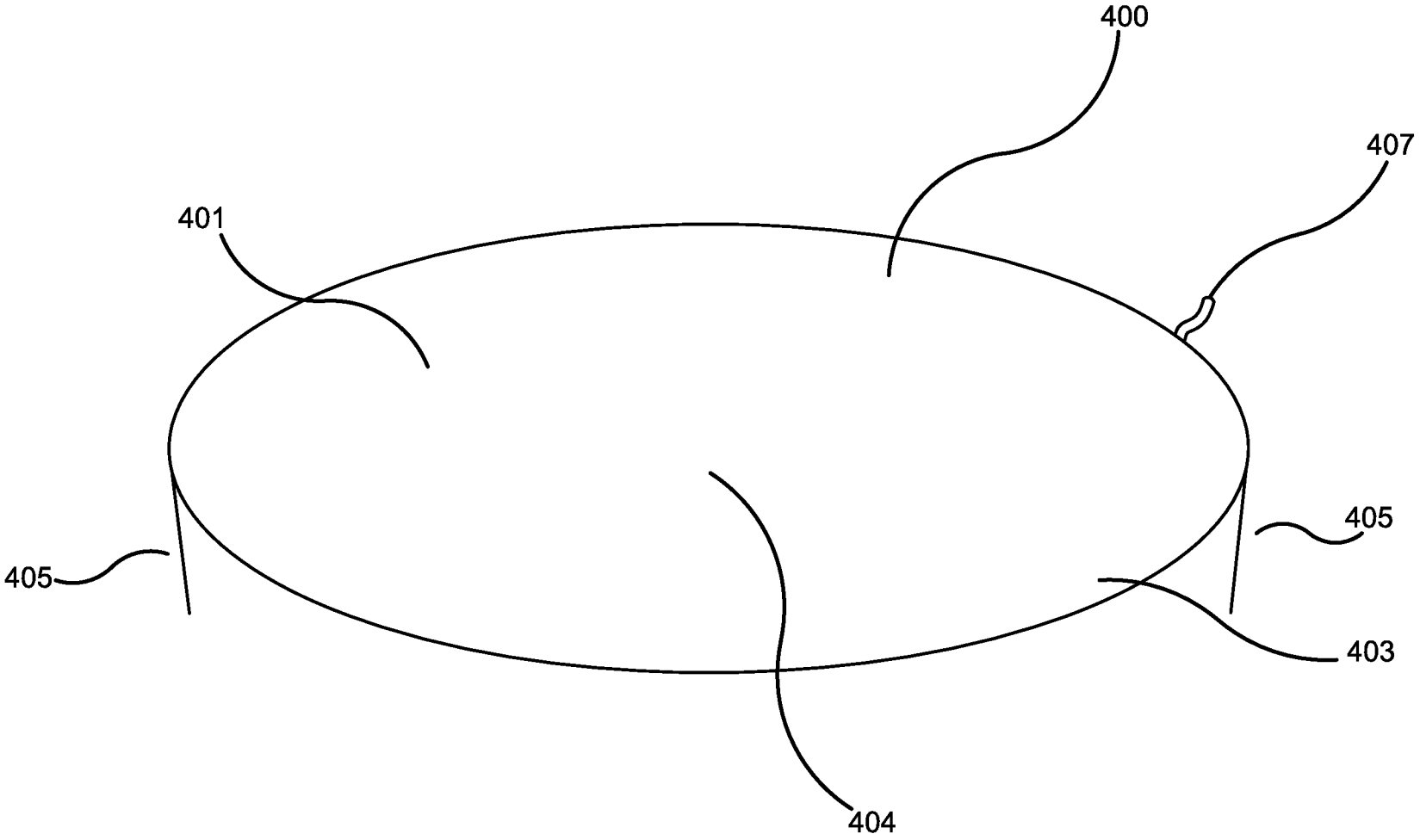
FIG. 4 illustrates a cross section of one potential embodiment of an inflatable cover or enclosure for a pool, spa or hot tub device of the present invention in accordance with the disclosed architecture.

FIG. 4 shows a cross section of the cover 400 of the present invention in which the cover has a top layer 401 and bottom layer 403 which forms an interior bladder 404 to hold the air which is introduced by valve 407. The top layer and bottom layer 401 and 403 are connected to the side surfaces 405 which when positioned on a pool, spa or hot tub is held in position so that the bladder 404 can be inflated to create the shaped raised central area. As an added benefit, as the cover is inflated it will form a natural seal with the side of the pool to prevent or at least reduce debris such as, but not limited to, leaves, grass clippings and other rubbish from entering the pool and necessitating the pool. Further, the cover may be inflated via a plurality of different mechanisms including, without limitation, a leaf blower, air compressor, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "inflatable cover or enclosure" and "device" are interchangeable and refer to the inflatable cover or enclosure 100 of the present invention.

Notwithstanding the forgoing, the inflatable cover or enclosure 100 of the present invention and its various components can be of any suitable size and configuration as is known in the art without affecting the overall concept of the invention, provided that they accomplish the above-stated objectives. One of ordinary skill in the art will appreciate that the size, configuration and material of the inflatable cover or enclosure 100 as shown in the FIGS. are for illustrative purposes only, and that many other sizes and shapes of the inflatable cover or enclosure 100 are well within the scope of the present disclosure. Although the dimensions of the inflatable cover or enclosure 100 are important design parameters for user convenience, the inflatable cover or enclosure 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cover or enclosure comprising:

a central area, and a side surface extending generally downwardly from the central area to form a cover or an enclosure for a pool, hot tub or spa;

the side surface having a hook and loop system retaining aid extending about a perimeter of the side surface;

at least one valve disposed in one of the central area or side surface for inflating the central area of the cover; and a gutter extending around a perimeter of the side surface connected to a downspout extending externally along a side of the pool, hot tub or spa configured to channel water runoff from the cover away from the pool, hot tub or spa;

an external water catchment system configured to retain water runoff for later use; and a filter positioned within the gutter for preventing debris from entering the external water catchment system.

2. The cover or enclosure of claim 1 further comprising a window in one of the central area or side surface to view an interior area of the cover.

3. The cover or enclosure of claim 1, wherein the central area is inflatable to create a raised area above a surface of water enclosed within the pool, hot tub or spa.

4. The cover or enclosure of claim 1 further comprising a sensor disposed in the cover, and the sensor detects one of an air pressure, a temperature, a cover height, a bacteria, an algae or a combination thereof.

5. The cover or enclosure of claim 4, wherein the sensor is connected to a smart phone having a downloaded program to receive information from the sensor.

6. The cover or enclosure of claim 1 further comprising a siren for providing a light, audible alarm or combinations thereof and the siren signals the cover has fallen below a predetermined inflation level.

7. A cover system comprising:

a first cover provided over one of a hot tub, spa or pool, wherein the first cover is solid in construction and configured to prevent debris from penetrating the cover;

a second cover inserted beneath the first cover, the second cover having a central area and a side surface extending generally downwardly from the central area, the second cover having at least one valve in one of the central area or side surface;

the second cover central area is inflatable to create a raised area under the first cover and the second cover has a retaining aid to hold the second cover in position under the first cover when inflate; and wherein the second cover further comprises a pump integrated into the side surface of the second cover and switchable air valve configured to permit both inflation and deflation of the second cover; and wherein the second cover further comprises a sensor for detecting a cover height.

8. The cover system as provided in claim 7, wherein the second cover includes a gutter extending around a periphery of the second cover and a downspout connected to the gutter.

9. A pool and cover combination comprising;

a pool having a perimeter;

a cover sized and configured to fit over the perimeter of the pool, the cover having a central area and a side surfaces and one of the central area or side surfaces having at least one switchable valve configured to permit both inflation and deflation of the cover;

the cover further comprising a window for viewing an area covered by the cover;

a pump integrated into the side surfaces connected to the at least one switchable valve;

the central area forming a raised area above the pool perimeter;

a gutter extending around a perimeter of the side surface connected to a downspout extending externally along a side of the pool configured to channel water runoff from the cover away from the pool;

an external water catchment system connected to the gutter and configured to retain water runoff for later use;

a filter positioned within the gutter for preventing debris from entering the external water catchment system; and a sensor connected to a smart phone and the sensor detects an algae level; and wherein the side surfaces further comprising a hook and loop retaining aid for securing the cover to the pool.

* * * * *